United States Patent [19]

Yang

[11] Patent Number: 4,722,523

[45] Date of Patent: Feb. 2, 1988

[54] ASSEMBLED MULTI-USE PHYSICAL FITNESS EXERCISER

[76] Inventor: Lien C. Yang, Fl. 9, No. 125, Sec. 3 Roosevelt Rd., Taipei, Taiwan

[21] Appl. No.: 852,271

[22] Filed: Apr. 15, 1986

[51] Int. Cl.[4] ..... A63B 11/02

[52] U.S. Cl. ..... 272/122; 272/62; 272/75; 272/117; 272/123; 272/137; 272/900

[58] Field of Search ..... 272/62, 75, 93, 117, 272/122, 123, 143, 900, 119, 137, 135, 142

[56] References Cited

U.S. PATENT DOCUMENTS

| | | | |
|---|---|---|---|
| 4,079,932 | 3/1978 | Schuetz | 272/75 |
| 4,157,827 | 6/1979 | Winston et al. | 272/75 |
| 4,185,816 | 1/1980 | Bernstein | 272/900 X |
| 4,199,140 | 4/1980 | Ferretti | 272/142 X |
| 4,361,324 | 11/1982 | Baroi | 272/123 |
| 4,440,391 | 4/1984 | Saenz, Jr. et al. | 272/93 |
| 4,473,225 | 9/1984 | Miller | 272/62 |
| 4,487,412 | 12/1984 | Meeko | 272/143 X |
| 4,618,142 | 10/1986 | Joseph | 272/75 |

FOREIGN PATENT DOCUMENTS

| | | | |
|---|---|---|---|
| 17640 | of 1900 | United Kingdom | 272/122 |

*Primary Examiner*—Richard J. Apley
*Assistant Examiner*—Robert W. Bahr
*Attorney, Agent, or Firm*—Armstrong, Nikaido, Marmelstein & Kubovcik

[57] ABSTRACT

An assembled Multi-Use physical fitness exerciser mainly includes the elements of metal bars, weight plates, hand grips, rubber belts, elastic rope, metal tube, supporting stands, auxiliary equipment, joint, hand protective pieces bolts, metal stoppers and end caps. With these elements one can assemble the exercises of a dumbbell set, a figure trimming bar, a barbell, a door exerciser set, a skip rope, a figure trimming skip rope, a chestpull, a rhythmic hand grip or an indoor horizontal bar.

1 Claim, 16 Drawing Figures

ASSEMBLED MULTI-USE PHYSICAL FITNESS EXERCISER

BACKGROUND OF THE INVENTION

The present invention relates to an assembled multi-use physical fitness exerciser, which can be assembled to provide many kinds of exercise or sporting equipment.

Most kinds of general physical fitness exercisers, such as dumbbells, barbells, chest pulls and skip ropes, have their specific shape and construction according to their unique function and using purpose. For instance, a dumbbell set is constructed of two bells connected by a bar; a barbell is composed of weight plates disposed at both ends of a longer bar; a chest pull includes two handles connected by pieces of pull spring; a skip rope is a piece of rope with two handles at both ends, optionally with weights in the handles.

Owing to the different shape and using purpose, each mentioned physical fitness exercises can be only used independently. When a user wants to do various gymnastics, he is now required to purchase all of the desired sets of physical fitness exercises. This causes a waste of money. In addition, it is not convenient for carrying and storing.

SUMMARY OF THE INVENTION

This invention includes primarily two metal bars, a set of weight plates, two hand protective pieces, short bolts and long bolts, etc. Each end of the metal bar is hollow and may have male and female coupling threads disposed at opposite ends respectively. A soft resilient cover enhances each metal bar except the end threaded region. The weight plates are categorized into two types; one has a screw hole at the center, a taper surface at one end of the screw hole and a flange around the other end of the screw hole, while the other category has only a central hole with a taper surface at one end of the central hole. The hand protective pieces are in general H-shape, comprising two strap portions. One strap portion has a floss adhesive part at one end and a bristle adhesive part at the reverse side of the other end, forming a quick fastener between the floss adhesive part and the bristle adhesive part. The other strap portion has opening holes at both ends, which are reinforced by metal washers. By the opening holes, the hand protective pieces can be hung on the metal bars. The weight plates can be also added on the metal bars on a users' option and fixed to the bars with the said short bolts or long bolts. The hand protective pieces are able to cover user's hands and be quickly fastened on them. Thus, the present invention may provide a weight-adjustable aerobic hand exerciser or dumbbell.

The present invention further includes two rubber belts and four end covers. The rubber belt has opening holes or sockets at both ends, which are reinforced by metal washers. The end caps are equipped with screw threads inside, to engage and connect ends of metal bars. When the two rubber belts are connected to the parallel metal bars, and fixed by screwing on the end caps, a chest-pull exerciser can be built up.

The present invention includes four further metal bars, wherein one metal bar has female threads at both ends, and the other three metal bars have female threads at one end and with male and female threads at the other end. The six metal bars can be coupled together to form a long bar. The end caps may be used to cover the two ends of the longer bar. A figure trimming bar exerciser is thus formed. when replacing the end caps with weight plates, the barbell exerciser can be quickly built up.

The present invention further includes an elastic rope. the two ends of the elastic rope are set in bearings disposed in small sleeves having female threads at inner surfaces. The sleeves, joined with the elastic rope and bearings, can be coupled with the said metal bars which have male threads at one end to form a weighted skip rope. the said end caps may cover the ends of the metal bars to provide a finished look.

The present invention further includes two metal stoppers and two hand grips which have a general D-Shape. With the mentioned metal stoppers, of which root portions have male threads and a scoop channel disposed radially through each of the threaded portions, the hand grips can be connected to the ends of the mentioned elastic rope and fastened to slotted portions in the hand grips to form a figure trimming skip rope.

The present invention further includes a metal tube, a joint and two supporting stands. Both the metal tube and the joint have a connecting portion in the shape of a polygon at one end. The joint has also a bolt or extension which can be engaged with the long bar coupled up by the mentioned metal bars. The metal tube can accommodate the long bar. The supporting stands can be installed and fixed on the walls beside a door entrance, and can accommodate the connecting portions of the joint and metal tube to build up an indoor horizontal bar exerciser.

The present invention further includes auxiliary equipment which can horizontally hold the mentioned metal bars, and can be clamped on the bottom edge or top edge of a door. Helped by the auxiliary equipment, exercises of body lifting can be setup.

DETAILED DESCRIPTION OF THE PREFERRED EMBODIMENT OF THE PRESENT INVENTION

Figure 1:
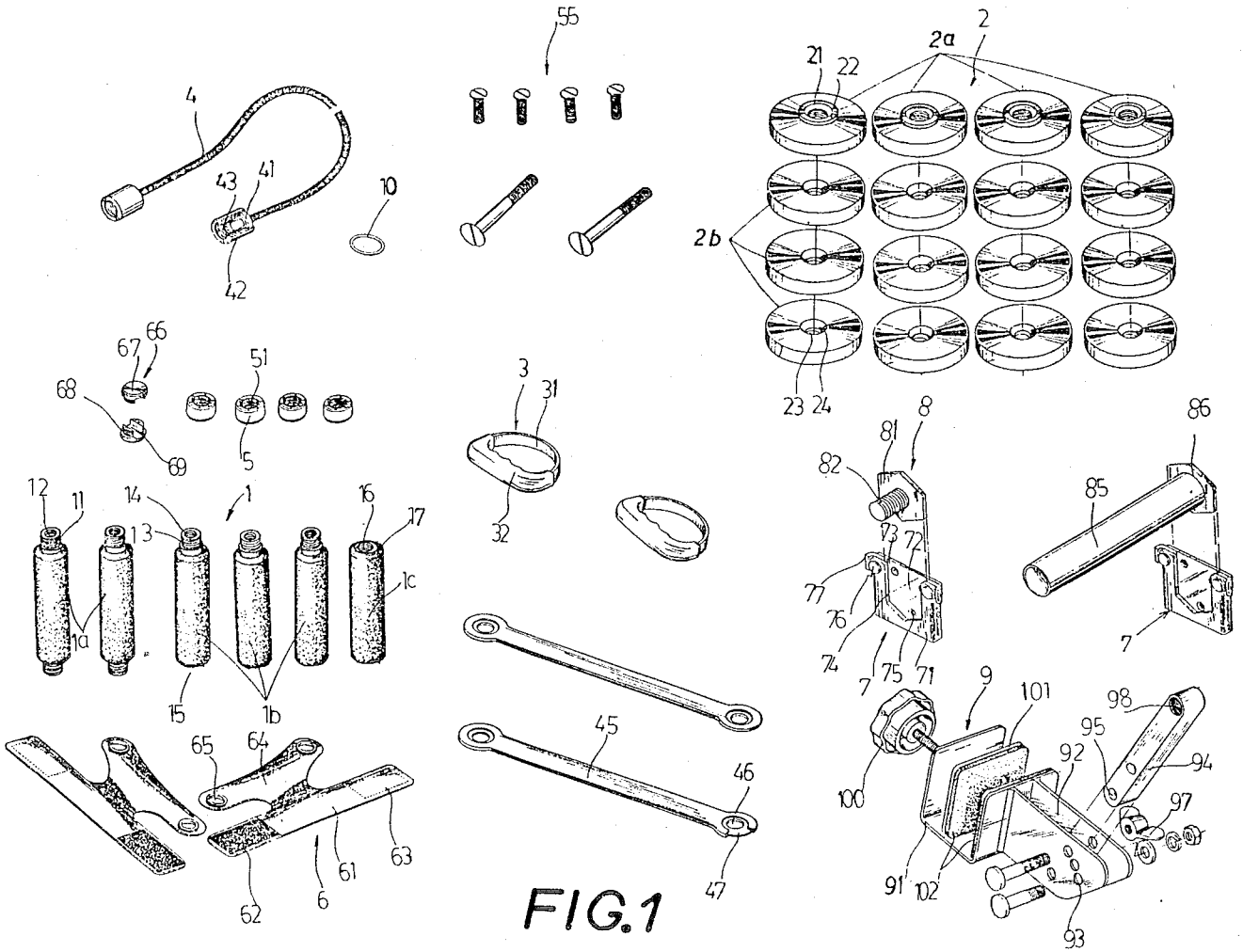
FIG. 1 shows the elements of a preferred embodiment of this invention.

As shown in FIG. 1, a preferred embodiment of the present invention is composed of six metal bars (1), a set of weight plates (2), two D-shaped hand grips (3), an elastic rope (4), two metal stoppers (66), two rubber belts (45), two hand protective pieces (6), two supporting stands (7), a joint (8), a metal tube (85), auxiliary equipment (9), a ring (10), short and long bolts (55), and four end caps (5). Among the metal bars, two metal bars (**1*a*) have male and female threads (11,12) at the outer and inner surfaces of both ends. Further three metal bars (1*b*) have female threads (15) at one end, and both male and female threads (13,14) at the other end. The other metal bar (1*c*) has female threads (16) at both ends. All the six metal bars can be jointed together as a long bar. There is a soft and resilient covering 17 on each metal bar (1*a*, 1*b*, 1*c***).

The weight plates (2) are categorized into two types (2*a*, 2*b*); each weight plate (2*a*) has a screw hole (21) at the center, and a taper surface at one end of the screw hole and a flange (22) around the other end of the screw hole, while the other category (2*b*) has only a central hole (23) with a taper surface (24) at one end of the central hole (23).

The two D-shaped hand grips (3) are integrally composed of a metal portion (31) and a plastic grip portion (32) which is formed as a wave shape on the inner surface for easy finger gripping.

The two ends of the elastic rope (4) are set in bearings (41) disposed in small sleeves (42) which have female threads (43) on inner surfaces. The female threads (43) have the same diameter with the male threads (11, 13 of the metal bars (1*a*, 1*b*).

The metal stoppers (66) have end surfaces (67) and male threads (68) at their root portions. A scoop channel (69) is formed through the male thread portion for accommodating a narrowed portion of the D-shaped metal portion (31) of the hand grip (3). (Please refer to FIG. 8) The male threads (68) are able to couple with the female threads (43) of the sleeves (42) of the elastic rope (4), and also with the female threads of the metal bars (1*b*, 1*c*).

The rubber belts (45) have opening holes (46) at both ends, which are reinforced by metal washers (47), having a diameter a little larger than the diameter of the male threads (11) of the metal bars (1*a*). Therefore, the rubber belts (45) can be hung on the metal bars (1*a*). (Please refer to FIG. 7)

The hand protective pieces (6) are in general H-shape, comprising two strap portions (64, 61). One strap portion (61) has a floss adhesive part (62) at one end and a bristle adhesive part (63) at the reverse side of the other end, to form a quick fastener between the floss adhesive part (62) and the bristle adhesive part (63). The other strap portion (64) has opening holes (65) at both ends, which are reinforced by metal washers. The opening holes (65), allow the hand protective pieces (6) can be hung on the metal bars (1*a*). (Please refer to FIG. 5) Further, by the design of the strap portion (61), the hand protective pieces are able to cover user's hands and be quickly fastened on them.

Both the joint (8) and the metal tube (85) have a connecting portion (81, 86) in the shape of a polygon at one end. The joint (8) has also a bolt extension (82) which can be engaged with the long bar formed by the coupled up metal bars (1*a*, 1*b*, 1*c*). (Please refer to FIG. 9) The metal tube (85) can accommodate the assembled long bar.

The supporting stands (7) comprise a front board (71), a rear board (72), two L-shaped stoppers (77) and rivets (76). Between the front board (71) and rear board (72), a groove space (73) is formed therein. The front board (71) has an opening upwardly directed. With the groove spaces (73), the supporting stands (7) can accommodate the connecting portions (81, 86) of the joint (8) and metal tube (85) respectively. The L-shaped stoppers (77) are engaged between the front board (71) and rear board (72) at the upper corners by rivets (76), helping to support the inserted connecting portions (81, 86).

The auxiliary equipment (9) comprises a regulating screw (100), a U-shaped holder (91), a clamp plate (101), two parallel flat members (92), projecting outwardly perpendicularly from a leg of the U-shaped holder, an upright bar (94), bolts, washers and a nut with handle (97); wherein the U-shaped holder (91) is provided to fasten to the bottom edge or top edge of the door. (Please refer to FIG. 15) The regulating screw is used to move the clamp plate (101) to fasten or loosen the clamp plate 101 to conform the door member. Rubber pad members (102) are disposed between the door member and clamp plate (101) and between the door member and the front end of U-shaped holder (91) for protecting the door member. the flat members (92) are extended from the front end of the U-shape holder (91). Several spaced sets of arranged holes (93) are provided on the flat boards (92). Two holes (95) on the upright bar (94) corresponding to the holes (93) are also provided. Bolts, washers and the nut with handle (97) are used to join the upright bar (94) and the flat members (92) in a manner that the angle of jointed upright bar (94), relating to the flat members is easily regulated. A screw hole (98) is provided on the upright bar (94) for accommodating and engaging with the said metal bars (1*a*, 1*b*).

Figures 2, 3:
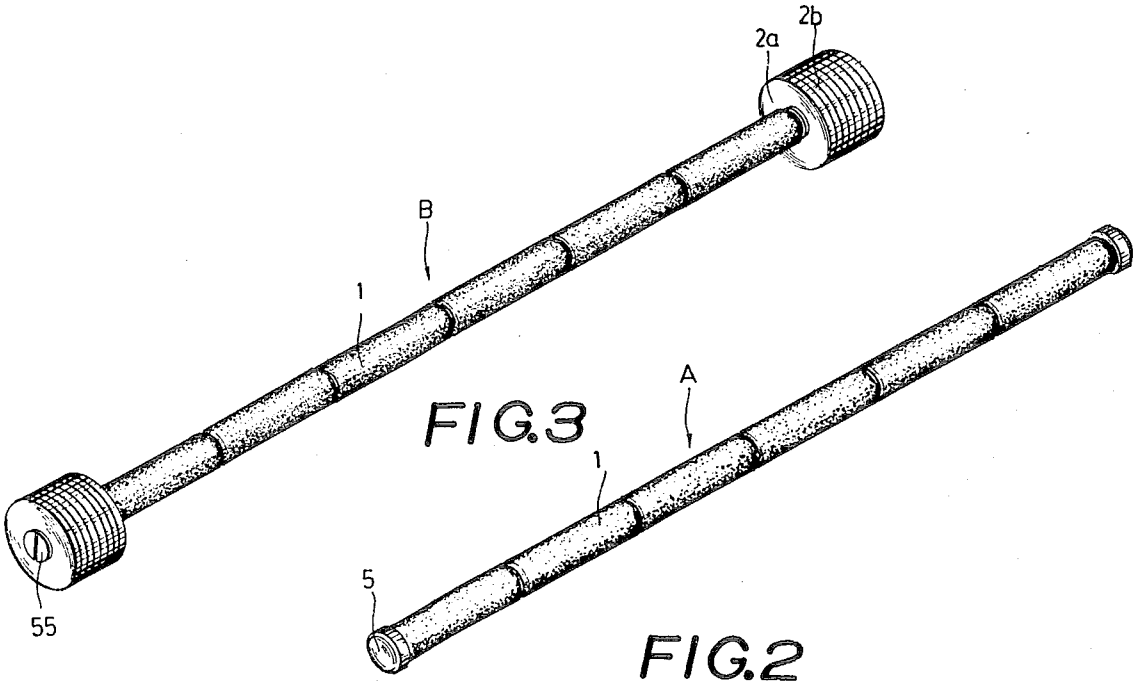
FIGS. 2–10 show the examples of physical fitness exercises assembled by the elements of this invention.
Figure 4:
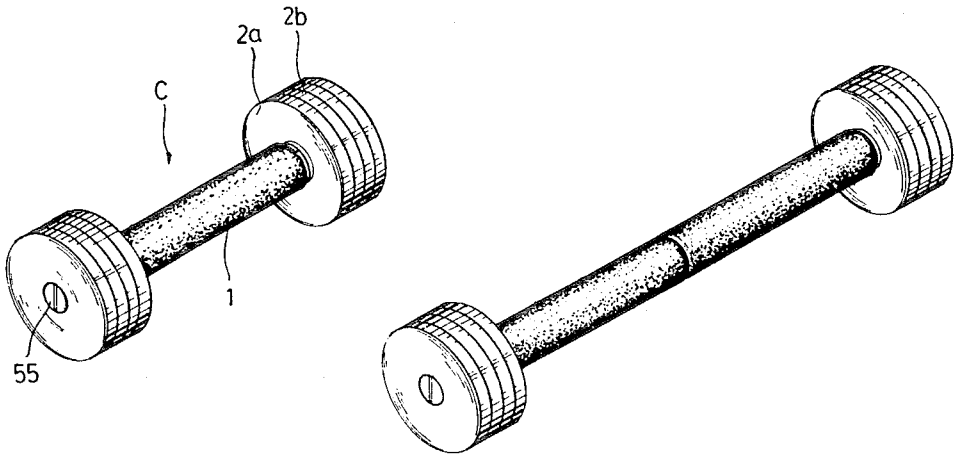
Figure 14:
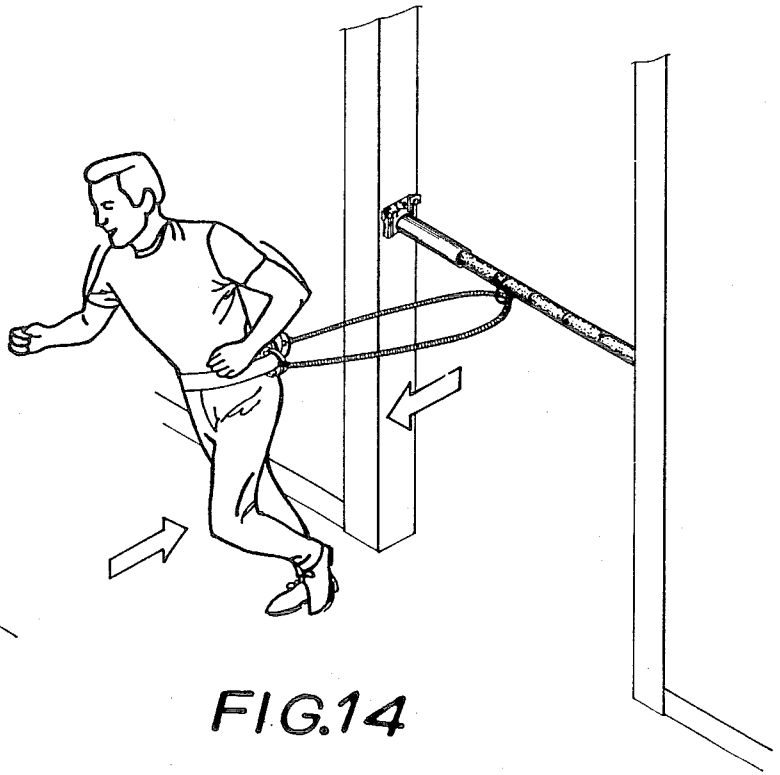
Figure 13:
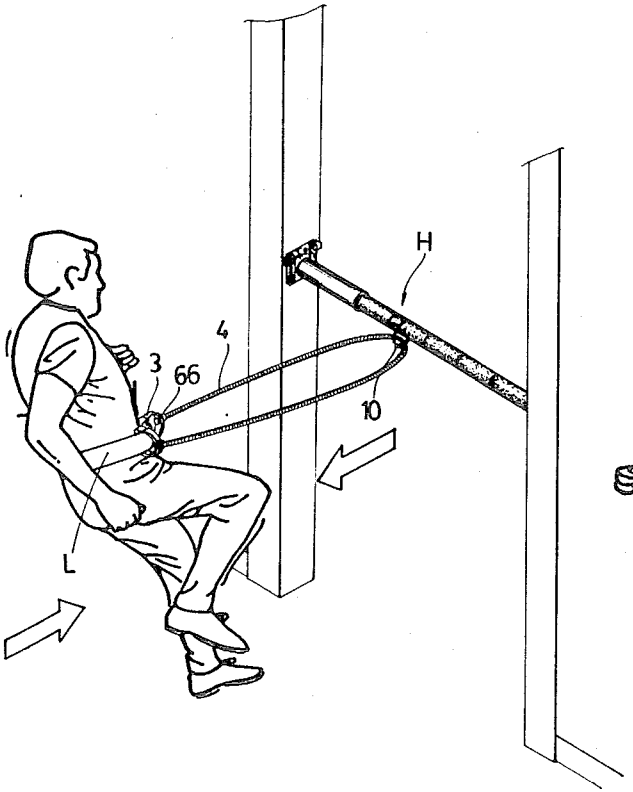

The ring (10) is provided to be clamped between two neighboring metal bars when users want to do some special exercises as shown in FIGS. 13 and 14. the short and long bolts (55) are used to join the weight plates (2) on the metal bars (1*a*, 1*b*) as shown in FIGS. 3 and 4. The end caps (5) with inner threads (51) are provided to cover the ends of the metal bars (1*a*, 1*b*).

Examples of physical fitness exercisers which can be assembled from the above elements of this invention are further described hereunder.

Figure Trimming Bar (A)

As shown in FIG. 2, coupling together all the metal bars (1), and using the end caps (5) to cover the ends of the resulting long bar, one can provide a figure trimming bar.

Barbell (B)

As shown in FIG. 3, replacing the end caps (5) with the weight plates (2), after fixing the weight plates to the long bar with bolts (55) one can provide a barbell.

Dumbbell (C)

As shown in FIG. 4, using just one or two metal bars 91), instead of the composite long bar of barbell exercisers, one can build up a dumbbell exerciser.

Rhythmic Hand Grip (D) and Aerobic Hand Exercisers

Figure 5:
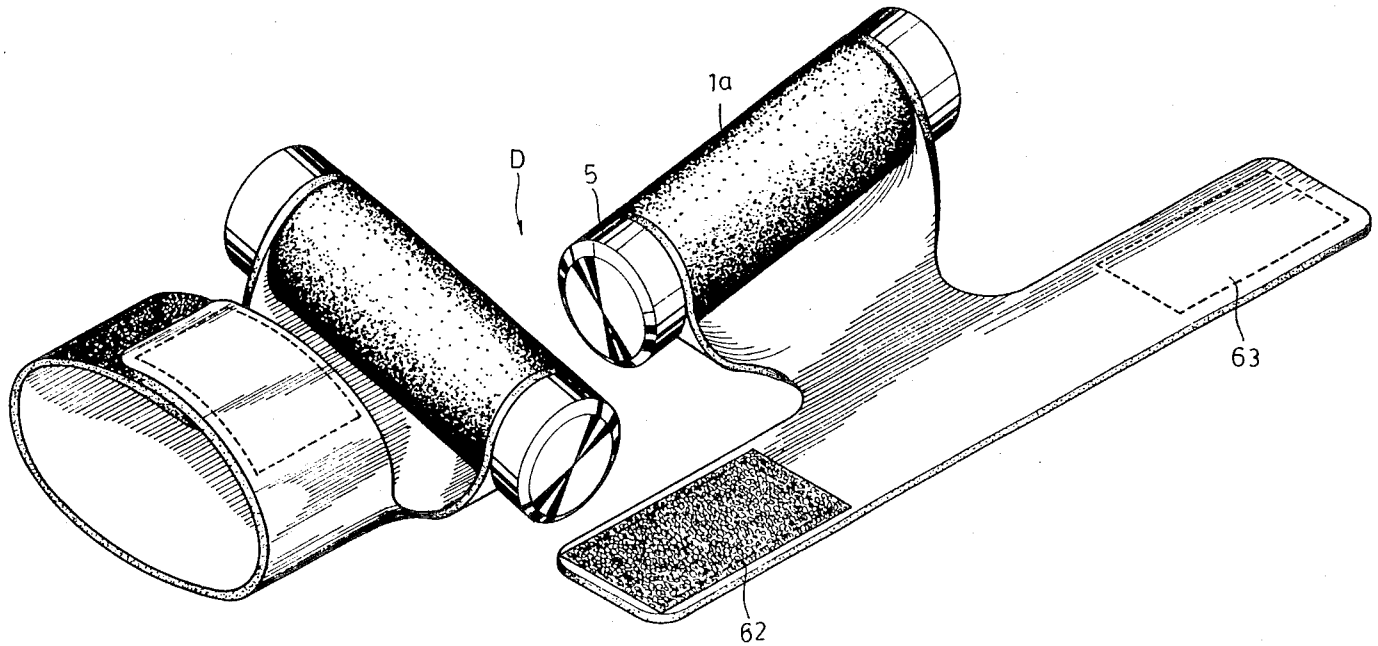

As shown in FIG. 5, joining the hand protective pieces on a metal bar (1*a*, 1*b*), using end caps (5) or metal stoppers (66) to cover the ends, one can set up a rhythmic hand grip exerciser. The H-shaped hand protective pieces are able to cover user's hands and be quickly fastened. Replacing the end caps (5) or metal stoppers (66) with weight plates (2) and using bolts (55) to fix them, one can obtain other forms of an aerobic hand exerciser.

Skip Rope (E)

Figure 6:
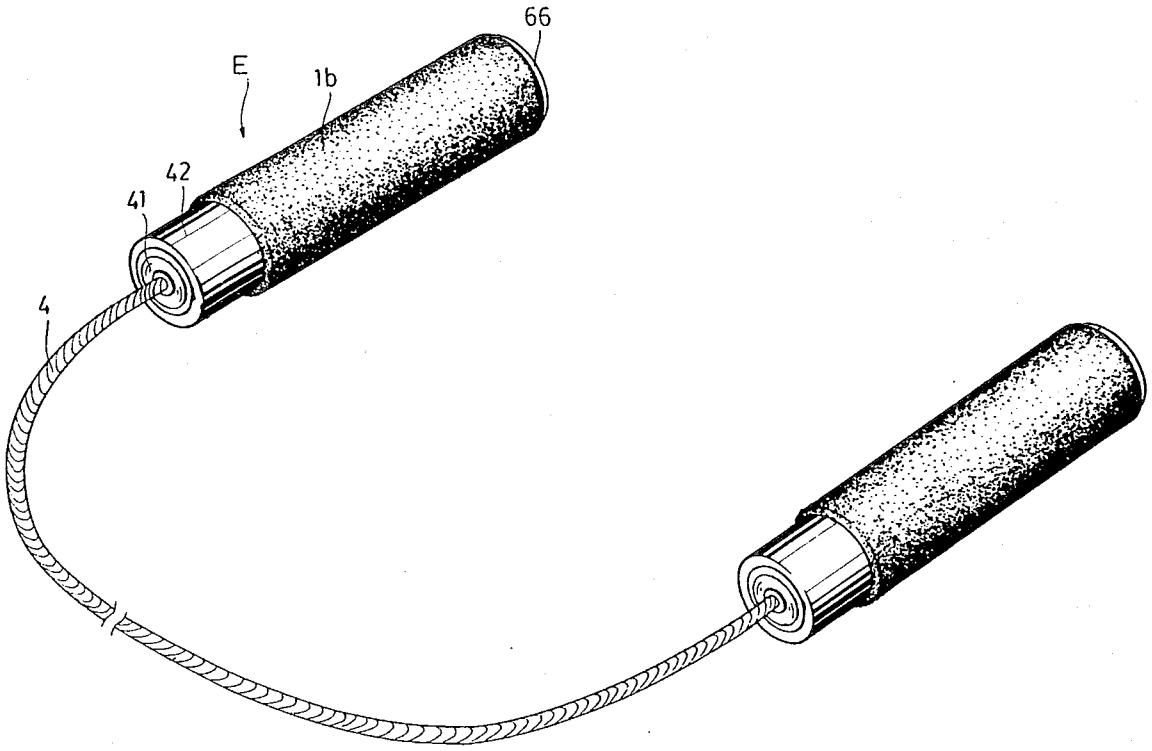

As shown in FIG. 6, joining two metal bars (1*a*, 1*b*) on the two sleeves (42) at two ends of the elastic rope and adding the ends caps (5) or metal stoppers (66), one can build a weighted skip rope.

Chest Pull (F)

Figure 7:
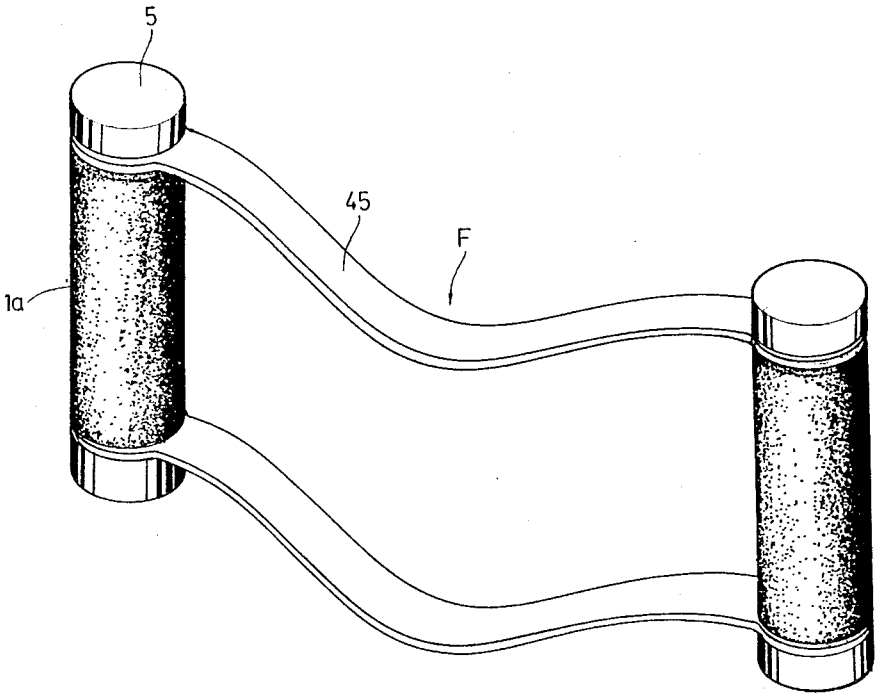

A shown in FIG. 7, by connecting the two ends of the rubber belts (45) on two parallel metal bars (1*a*) and adding the end caps (5), a chest pull exerciser is thus obtained.

Figure Trimming Skip Rope (G)

Figure 8:
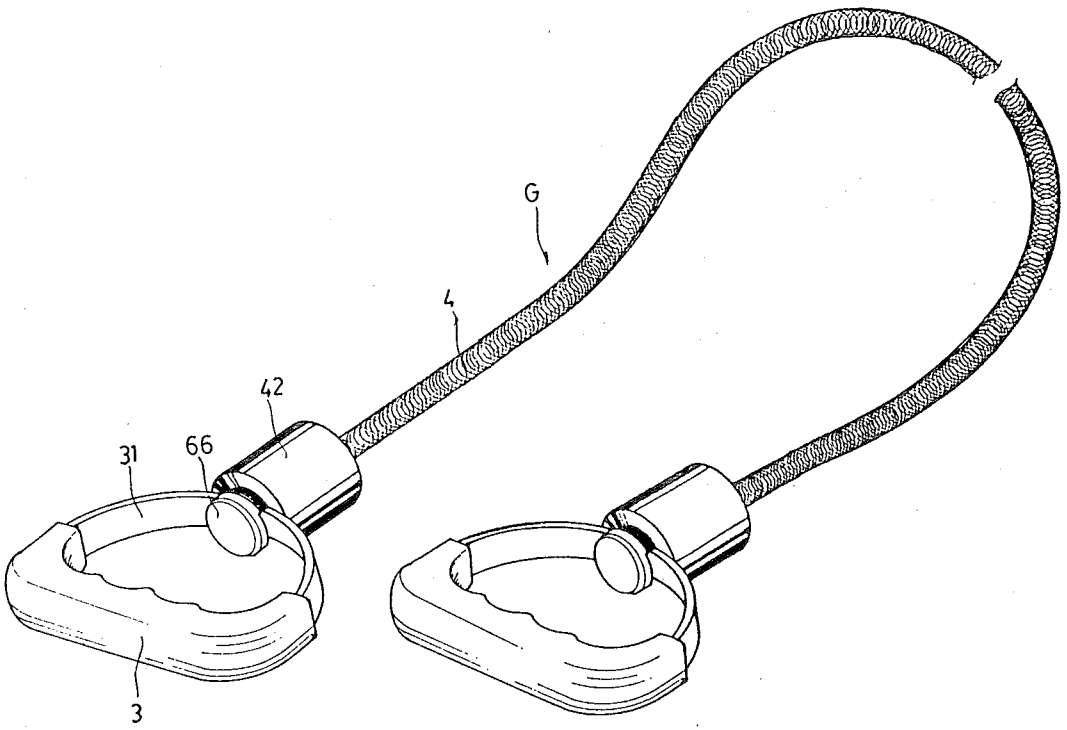

As shown in FIG. 8, by joining the two D-shaped hand grips (3) with sleeves (42) at two ends of elastic rope (4) by the metal stoppers (66), a figure trimming skip rope can be built up. Examples of exercising are shown in FIGS. 11 to 14.

Indoor Horizontal Bar (H)

Figure 9:
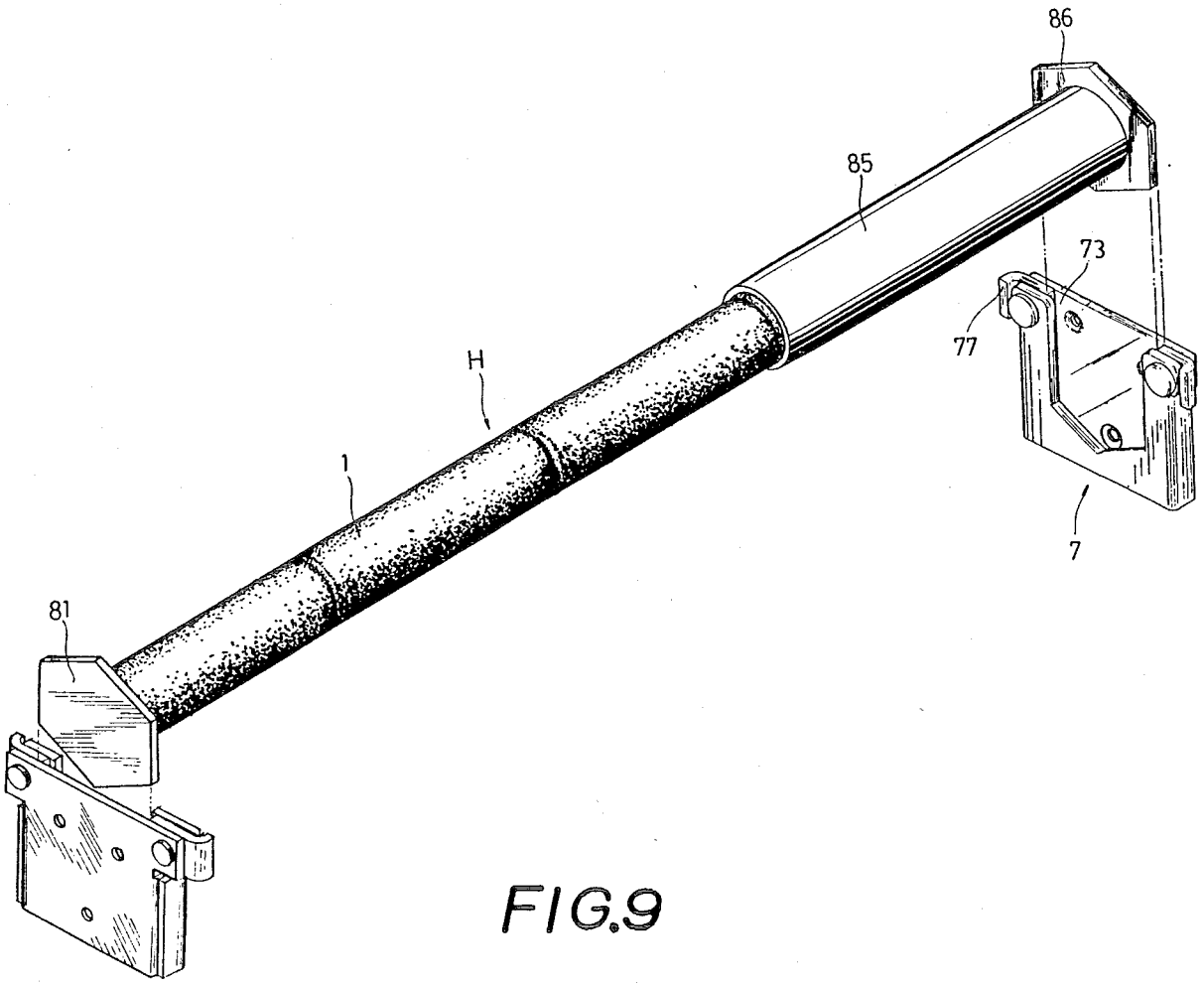
Figure 10:
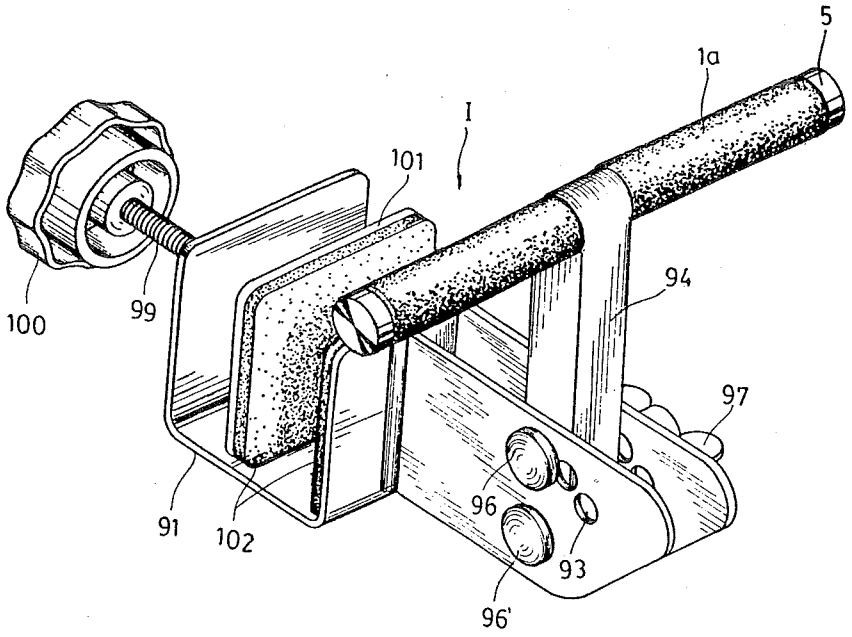
Figure 12:
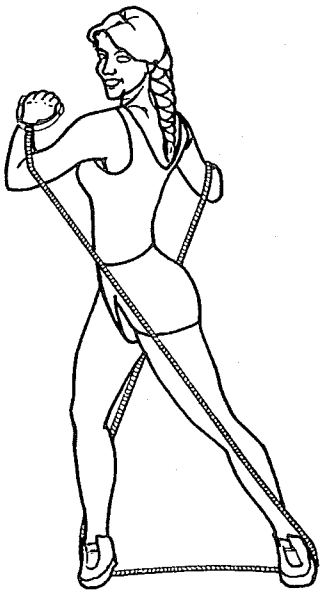
FIGS. 11–14 show the examples of figure trimming skip ropes.
Figure 11:
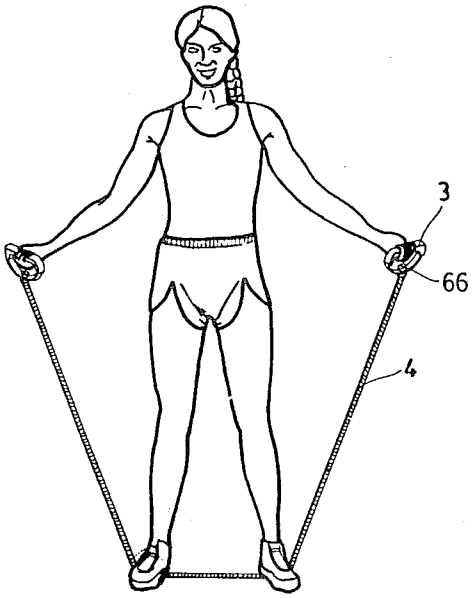

As shown in FIG. 9, by fixing the supporting stands on the walls beside the door entrance; and joining some of the metal bars 91) together and engaging with the joint (8); further, using the metal tube (85) to accommodate the end of the jointed long bar; and then regulating the length of the long bar beyond the accommodating of the metal tube (85) according to the distance between the two fixed supporting stands; and inserting the connecting portions (81, 86) into the groove spaces (73) of supporting stands; one can easily set up an indoor horizontal bar for exercising in one's room.

Upper Door Exerciser

Figure 16:
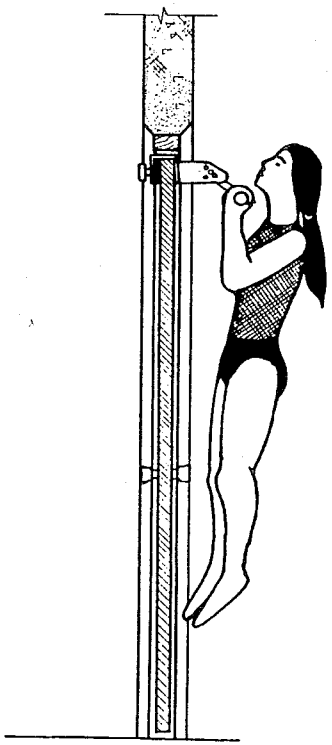
FIGS. 15–16 show the examples of upper door and bottom door exercises.

As shown in FIG. 16, by clamping the auxiliary equipment (9) on the top edge of door member, joining at least two metal bars (1*a*, 1*b*) on the upright bar (94) and adding the end caps (5) or the metal stoppers (66), on the outside ends of the metal bars (1*a*, 1*b*), an upper door exerciser can be provided for body lifting exercises.

Lower Door Exerciser

Figure 15:
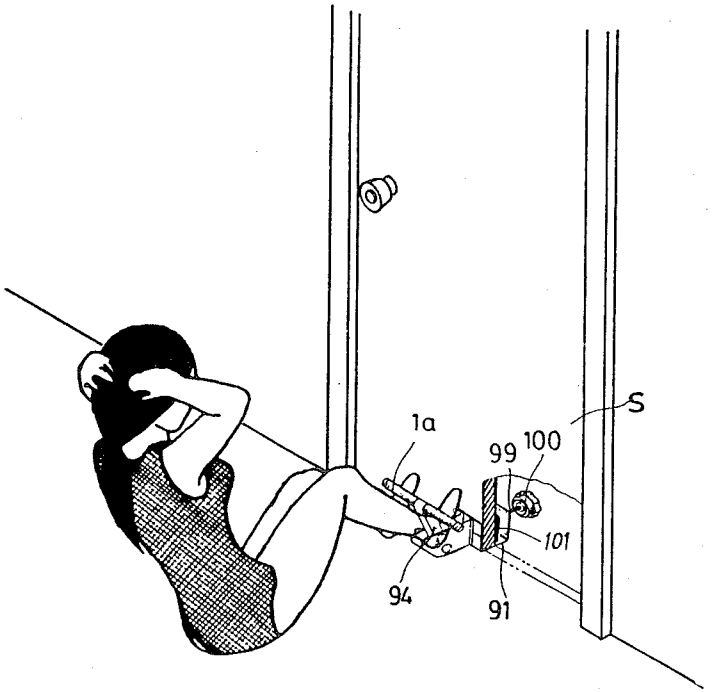

As shown in FIG. 15, by clamping the auxiliary equipment (9) on the bottom edge of door member, one can obtain a lower door exerciser for body rising and lying exercises. Further, the height of metal bars (1*a*, 1*b*) can be regulated according to various sizes of user's feet, by properly fixing the upright bar (94) on the auxiliary equipment (9).

To sum up, with the compact elements provided by the present invention, many kinds of physical fitness exercisers can be assembled. This not only allows users to save much money on exercise equipment, but also allows them to save much trouble when carrying and storing the equipment.

I claim:

1. A multi-use physical fitness exerciser comprising, in combination:

(a) a plurality of metal bars with detachably interconnecting threaded ends for forming an elongated bar;

(b) a plurality of weight plates apertured at their center and detachably connectable to each other and with at least one of said metal bars;

(c) a pair of hand grips;

(d) an elastic rope with means at each end for detachably interconnecting said elastic rope with said hand grips and with said metal bars;

(e) hand protective and grip members, each member having an H-shaped flat configuration, one leg of said member having ends that are detachably connectable to surround the back of a person's hand and the other leg having reinforced eyelets detachably connectable to the end portions of said metal bars without interfering with the interconnection of said bars;

(f) support members detachably connectable to opposite sides of a doorway to permit support of said metal bars;

(g) an auxiliary support members detachably connectable to the top of a door and selectively to the bottom of a door;

(h) elastic belts detachably connectable to ends of said metal bars; and (i) a ring having a larger diameter than said metal bar and detachably disposed on said elongated bar to allow attachment of said elastic rope and said hand grips;

wherein said items are capable of fitting together with other ones of said items to provide various exercisers to tone up and improve the human body.

* * * * *